US008834049B2

(12) United States Patent
Kurashina

(10) Patent No.: US 8,834,049 B2
(45) Date of Patent: Sep. 16, 2014

(54) PRINT SYSTEM, PAPER PRINTER, AND METHOD OF CONTROLLING PRINT SYSTEM

(75) Inventor: Hiroyasu Kurashina, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1798 days.

(21) Appl. No.: 11/838,689

(22) Filed: Aug. 14, 2007

(65) Prior Publication Data

US 2008/0053324 A1 Mar. 6, 2008

(30) Foreign Application Priority Data

Aug. 31, 2006 (JP) ..... 2006-236784

(51) Int. Cl.

| | |
|---|---|
| ***B41J 11/20*** | (2006.01) |
| ***B65H 3/06*** | (2006.01) |
| ***B41J 3/407*** | (2006.01) |
| ***B41J 33/06*** | (2006.01) |
| ***B41J 33/14*** | (2006.01) |
| ***B41J 13/00*** | (2006.01) |
| ***B41J 13/02*** | (2006.01) |
| ***B41J 13/10*** | (2006.01) |

(52) U.S. Cl.

CPC ..... *B41J 33/06* (2013.01); *B65H 3/0623* (2013.01); *B41J 3/4075* (2013.01); *B41J 33/14* (2013.01); *B41J 13/0027* (2013.01); *B41J 13/025* (2013.01); *B41J 11/20* (2013.01); *B41J 13/103* (2013.01)

USPC ..... 400/649; 400/663

(58) Field of Classification Search

CPC ..... B41J 33/06; B41J 33/14; B41J 13/025; B41J 11/20; B41J 3/407; B41J 13/00; B65H 2701/1934; B65H 3/0623

USPC ..... 400/649, 76, 624, 625, 663, 660.2, 664

IPC ..... B41J 33/54

See application file for complete search history.

(56) References Cited

U.S. PATENT DOCUMENTS

| | | | | |
|---|---|---|---|---|
| 5,618,062 | A * | 4/1997 | Mertens et al. | 283/67 |
| 5,681,123 | A * | 10/1997 | Yamaguchi | 400/586 |
| 2004/0234314 | A1 * | 11/2004 | Tozaki et al. | 400/120.01 |
| 2005/0208250 | A1 * | 9/2005 | Blank et al. | 428/40.1 |

FOREIGN PATENT DOCUMENTS

| | | | |
|---|---|---|---|
| JP | 05050729 | A * | 3/1993 |
| JP | 08174881 | A * | 7/1996 |

(Continued)

*Primary Examiner* — Judy Nguyen
*Assistant Examiner* — Jennifer Simmons
(74) *Attorney, Agent, or Firm* — DLA Piper LLP (US)

(57) ABSTRACT

A print system includes a paper feed device; a print device which has a platen roller and a print head and inserts the fed paper and an ink ribbon at a head position between the platen roller and the print head to perform printing; a disjunction device which relatively moves the platen roller with respect to the print head between a contact position where the platen roller contacts and a separation position where the platen roller is away therefrom; a non-print section acquiring device which acquires non-print section data of a character image in a feed direction of the paper from print data; and a print control device which controls the devices. The print control device relatively moves the platen roller to the separation position during a non-print section of the fed paper passes through the print head, based on the non-print section data.

11 Claims, 11 Drawing Sheets

(56) References Cited

FOREIGN PATENT DOCUMENTS

| | | | | |
|---|---|---|---|---|
| JP | 09123495 | A | | 5/1997 |
| JP | 2003-011437 | | | 1/2003 |
| JP | 2003011437 | A | * | 1/2003 |
| JP | 2004017609 | A | * | 1/2004 |

* cited by examiner

PRINT SYSTEM, PAPER PRINTER, AND METHOD OF CONTROLLING PRINT SYSTEM

The entire disclosure of Japanese Patent Application No. 2006-236784, filed Aug. 31, 2006, is expressly incorporated by reference herein.

BACKGROUND

1. Technical Field

The present invention relates to a print system for performing printing on a paper via an ink ribbon while feeding the paper and the ink ribbon together, a paper printer, and a method of controlling the print system.

2. Related Art

In the related art, as a paper printer, a sticky note printer for printing print data on the surface of a fed sticky note is known. This sticky note printer feeds an ink ribbon in synchronization with the feed of the sticky note, inserts the sticky note and the ink ribbon between a platen roller and a thermal head, and performs printing on the sticky note by heat driving of the thermal head while feeding the sticky note and the ink ribbon in the same direction. In this case, the platen roller also functions as a feed roller for feeding the sticky note, and the feed roller and a winding shaft for winding the ink ribbon are driven by a single motor (JP-A-2003-11437).

However, in the sticky note printer, since the sticky note and the ink ribbon are fed together in a state that the sticky note and the ink ribbon are inserted between the platen roller and the thermal head at the time of printing, the ink ribbon is fed even when a blank portion of the sticky note, on which printing is not to be performed, is fed. Accordingly, the ink ribbon is needlessly wasted. In order to reduce such waste, it may be considered that the feeding of the ink ribbon is stopped when a blank portion is being fed. However, in this case, the surface of the sticky note may be affected by friction between the sticky note and the ink ribbon or the ink ribbon may be forcedly ejected

SUMMARY

An advantage of some aspects of the invention is that it provides a print system, a paper printer, and a method of controlling the print system, which are capable of suppressing wastage of an ink ribbon without influencing printing on paper.

According to an aspect of the invention, there is provided a print system including: a paper feed device which feeds paper; a print device which has a platen roller and a print head and inserts the fed paper and an ink ribbon at a head position between the platen roller and the print head to perform printing; a disjunction device which relatively moves the platen roller with respect to the print head between a contact position where the platen roller contacts the print head and a separation position where the platen roller does not contact the print head; a non-print section acquiring device which acquires non-print section data of a character image in a feed direction of the paper from print data including the character image having at least one character printed on the paper and positional data of the character image on the paper; and a print control device which controls the paper feed device, the print device, the disjunction device and the non-print section acquiring device, wherein the print control device relatively moves the plate roller to the separation position for a period during which a non-print section of the fed paper passes through the print head, on the basis of the non-print section data.

In this case, the print system may include a detection device which detects that the platen roller has relatively moved to the separation position with respect to the print head; and a ribbon feed device which feeds the ink ribbon along with the fed paper, and the print control device may control the ribbon feed device to stop the feed of the ink ribbon when the detection device detects that the platen roller has relatively moved to the separation position.

According to another aspect of the invention, there is provided a method of controlling a print system including a paper feed device which feeds paper; a print device which has a platen roller and a print head and inserts the fed paper and an ink ribbon at a head position between the platen roller and the print head to perform printing; and a disjunction device which relatively moves the platen roller with respect to the print head between a contact position where the platen roller contacts the print head and a separation position where the platen roller is separated from the print head; the method including: acquiring non-print section data of a character image in a feed direction of the paper from print data including the character image printed on the paper and positional data of the character image on the paper; and relatively moving the plate roller to the separation position for a period during which a non-print section of the fed paper passes through the print head, on the basis of the acquired non-print section data.

By this configuration, when the non-print section in the feed direction of the paper is made to approach the print head, the space between the print head and the platen roller is opened and the paper is fed in a state that the ink ribbon is stopped. Accordingly, since the ink ribbon is not fed in the non-print section, the waste of the ink ribbon corresponding to the length of the non-print section can be suppressed and the running cost of the user can be reduced. Since the paper and the ink ribbon are fed in a state that the paper and the ink ribbon are separated from each other, the surface of the paper not contaminated by friction between the paper and the ink ribbon or the ink ribbon is not forcedly extracted.

Since the detection device can accurately detect that the platen roller is moved to the separation position, the control can be performed with high precision by performing the control on the basis of the detected result. For example, a false operation in which the paper is fed in a state that a blank portion of the paper contacts the print head due to failure of the disjunction device can be prevented with certainty. When power supply is stopped during the operation, since the position of the platen roller can be more accurately identified when power is supplied again, appropriate control can be performed when the operation resumes.

In this case, the ribbon feed device may include a ribbon winding shaft on which the ink ribbon is wound; a driving device which is a driving source; a clutch device which transmits a driving force of the driving device to the ribbon winding shaft or blocks the driving force from being transmitted to the ribbon winding shaft according to the movement of the platen roller, and the clutch device may separate the platen roller from the contact position by the disjunction device and block the driving force to stop the feed of the ink ribbon.

By this configuration, when the platen roller is moved to the contact position, the driving force is transmitted to the driving device to the ribbon winding shaft to feed the ink ribbon. When the platen roller is separated from the contact position, the driving force is blocked from being transmitted to the ribbon winding shaft and the feed of the ink ribbon is stopped. That is, the print control device controls the movement of the platen roller by the disjunction device such that the feed and the stop of the ink ribbon can be controlled.

In this case, the print system may further include a feed amount calculating device which calculates a paper feed amount from a time point when the paper feed device starts to feed the paper, on the basis of the non-print section data, and the print control device may control the non-print section to approach the print head, on the basis of the calculated paper feed amount.

By this configuration, it is possible to control the feed of the ink ribbon to be stopped by the length of the non-print section from a time point when the non-print section is made to approach the print head on the paper feed amount of the paper feed device and to control the platen roller to move to the separation position.

In this case, the feed amount calculating device may calculate the paper feed amount from a print dot number.

By this configuration, the control can be performed with high precision on the basis of the dot number.

In this case, the paper feed device may have any one of a stepping motor and an encoder-equipped motor, and the feed amount calculating device may calculate the paper feed amount from a rotation amount of the motor.

By this configuration, the control can be performed according to the rotation amount of the motor and thus the control can be easily performed.

In this case, the feed amount calculating device may calculate the paper feed amount from a paper feed speed and a paper feed time of the paper feed device.

By this configuration, since the paper feed distance is calculated from the paper feed speed and the paper feed time, the control can be performed on the basis of the paper feed distance. Accordingly, the control can be easily performed.

In this case, a plurality of non-print sections may include at least one of a front blank section and a back blank section of the paper.

By this configuration, it is possible to suppress the waste of the ink ribbon corresponding to the lengths of the front blank and the back blank of the paper.

In this case, the paper may be a sticky note which is separated from a bundle of sticky notes including a plurality of sticky notes one end of which is respectively pasted.

By this configuration, the front and back blanks of the sticky note are larger than those of a regular paper. Accordingly, a wider handwriting space may be formed in the front and back blank. Even when the bundle of sticky notes are stored to be reversed by mistake, the sticky note can be fed in a state that the paste portion of the sticky note are separated from the ink ribbon, by setting the blank (non-print section) of the sticky note in the feed direction to be wider than the paste portion of one end of the sticky note.

In this case, the print system may include a paper printer including the paper feed device, the ribbon feed device, the print device, the disjunction device, and the detection device; and an information processing terminal which includes the non-print section acquiring device, the print control device, and the feed amount calculating device, connects to the paper printer, and performs an information process including control of the paper printer.

By this configuration, the paper printer can accurately perform print control without performing a complicated information process. Accordingly, the configuration of the paper printer can be simplified and the small size and the low cost of the paper printer can be realized.

According to another aspect of the invention, there is provided a paper printer including all devices of the print system.

By this configuration, the paper printer can perform printing while suppressing the waste of the ink ribbon, without influencing the printing on the paper.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a print system according to a first embodiment of the invention will be described using a sticky note print system with reference to the accompanying drawings. In the sticky note print system according to the invention, a ribbon cartridge, in which an ink ribbon is stored, is detachably mounted, the ink ribbon is fed along with a sticky note while feeding the sticky note from a bundle of sticky notes, and the feed of the ink ribbon is stopped in accordance with feed of a non-print section such as a blank portion, on the basis of print data edited by a personal computer.

Figure 1:
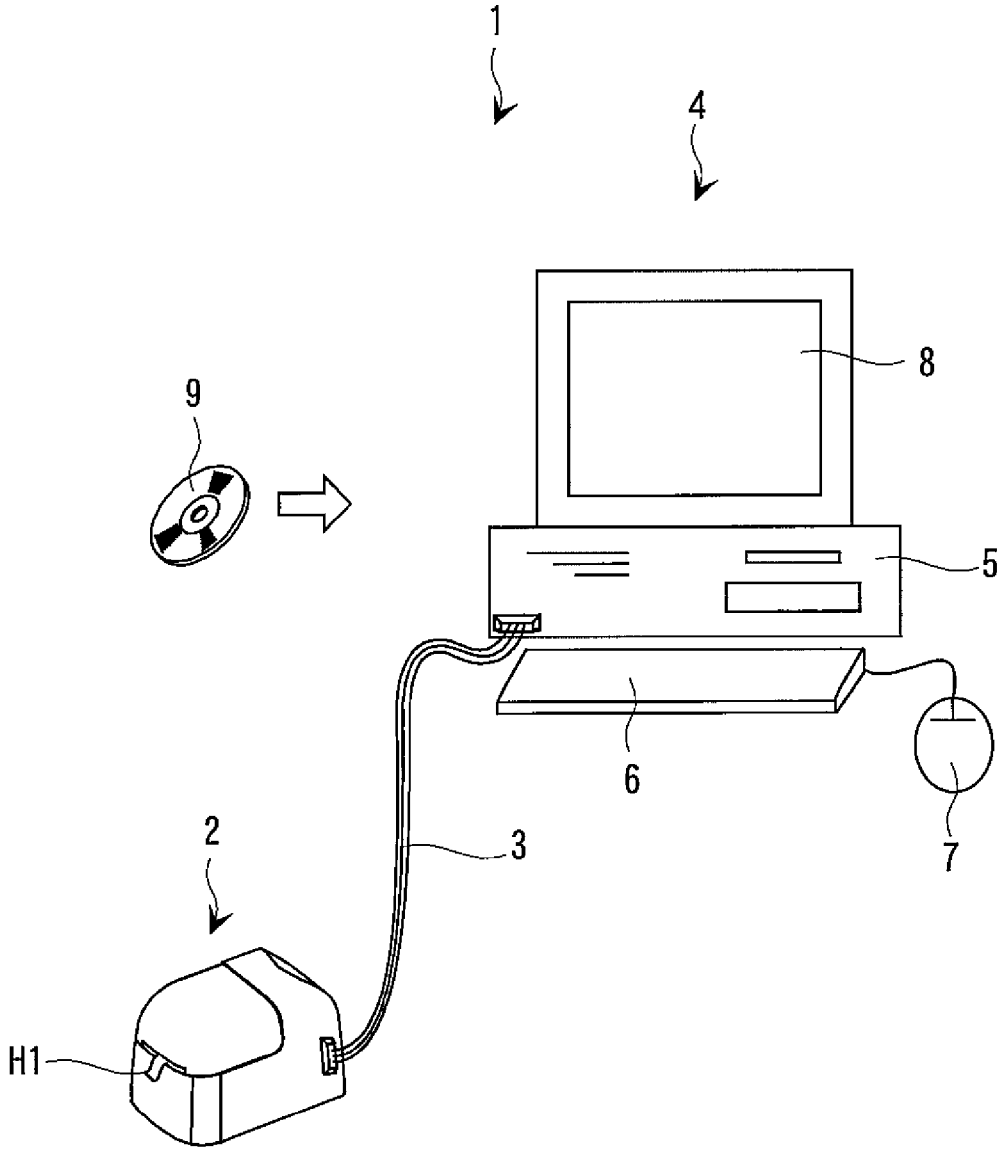
FIG. 1 is a view showing the entire configuration of a sticky note print system.

First, the configuration of the sticky note print system 1 (print system) will be described with reference to FIG. 1. The sticky note print system 1 includes a sticky note printer 2 (paper printer) in which a sticky note bundle H is stored and a personal computer 4 (control terminal), which is connected to the sticky note printer 2 via a USB cable 3, for preparing and editing print data which will be printed on a sticky note H1 and controlling a variety of driving operations of the sticky note printer 2.

The personal computer 4 includes a personal computer body 5, a keyboard 6 and mouse 7, which are connected to the personal computer body 5 so as to allow input of data, and a display 8 for displaying an input result. In the personal computer body 5, a CD-ROM 9 for storing data such as a device driver or application software of the sticky note printer 2 is mounted. When a variety of detection signals, a variety of instructions, or a variety of data is input via the keyboard 6, the personal computer 4 processes the variety of data according to a program stored in the CD-ROM 9 to control the sticky note printer 2. For example, in the present embodiment, non-print section data detailing sections on which printing is not to be performed on the sticky note H1 is calculated from the print data by the application software stored in the CD-ROM 9 (described later) and is transmitted to the sticky note printer 2 to control the printing.

A function for controlling each unit may be provided in the sticky note printer 2 such that the printing is performed on the basis of the print data prepared and edited by the personal computer 4 or a function for controlling each unit or a function for preparing and editing the print data may be provided in the sticky note printer 2 such that the printing is performed on the sticky note H1 using the sticky note printer 2 as a single body.

Figure 2:
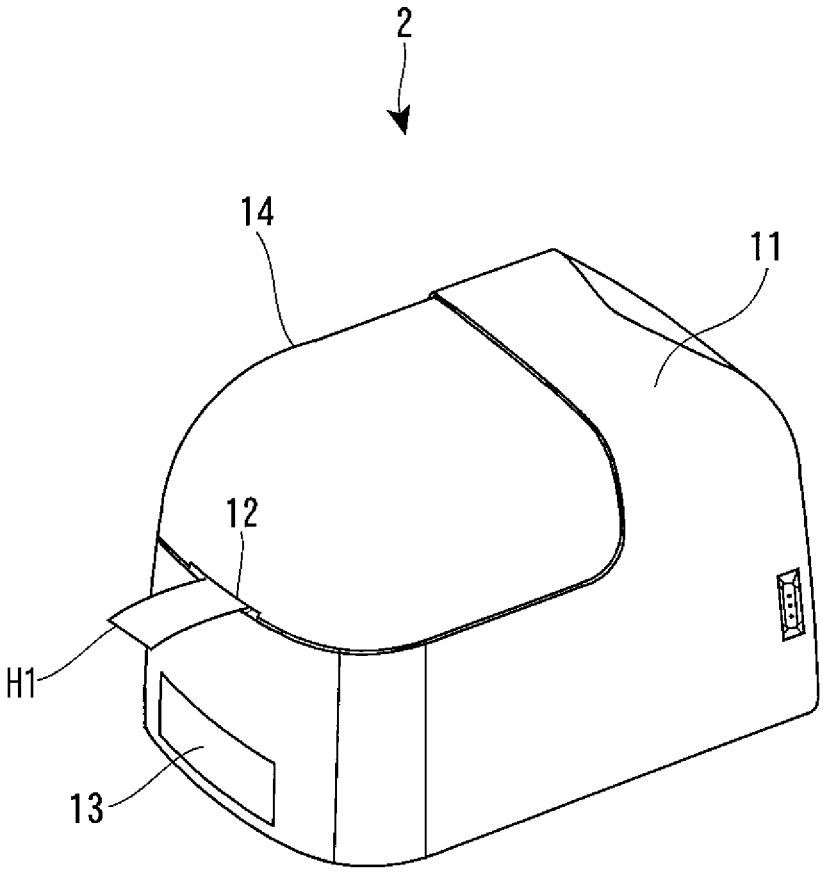
FIG. 2 is an appearance perspective view of a sticky note printer.

As shown in FIG. 2, the outer shell of the sticky note printer 2 is formed by a device casing 11 and the inside of the device casing 11 is configured such that the sticky note bundle H can be stored therein. The sticky note printer 2 prints a desired character image P (see FIG. 7) prepared by the personal computer 4 on the sticky notes H1 separated from the sticky note bundle H one by one and ejects the sticky note via an ejection slot 12 formed in the device casing 11.

The device casing 11 is formed to have a small size. A sticky note insertion opening 13 for allowing insertion of the below-described sticky note holder 21 from the front side of the casing into the casing in a draw-out type is formed in the lower portion of the front surface of the device casing 11. The horizontal-slit-shaped ejection slot 12 for ejecting the sticky note H1, on which the printing has been completed, to the outside of the casing is formed in the central portion of the front surface of the casing. A ribbon cartridge C for receiving the ink ribbon R is mounted and an openable cover 14 for maintenance is attached on the surface of the device casing 11.

Figure 3:
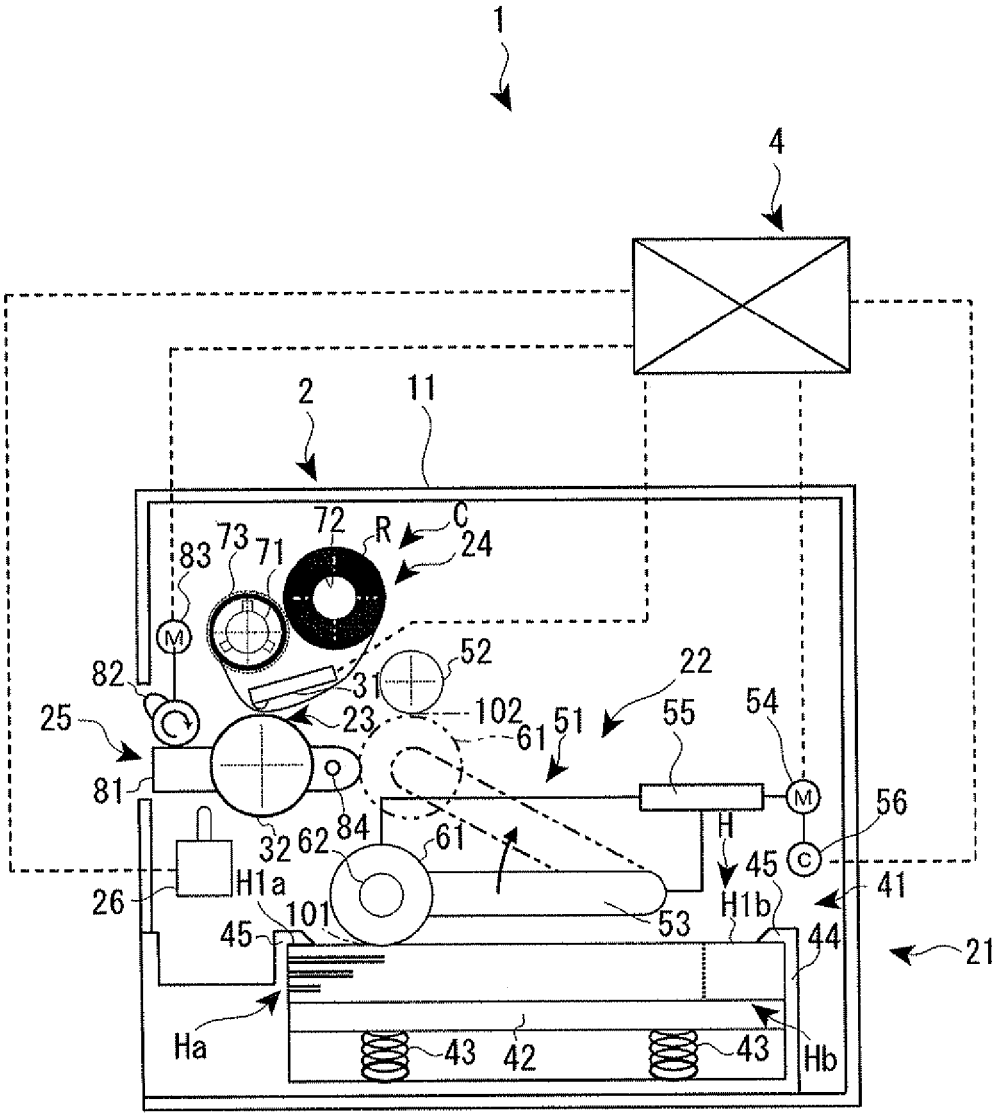
FIG. 3 is a schematic view showing an example of the cross section of the sticky note printer.

As shown in FIG. 3, the sticky note bundle H includes a plurality of sticky notes H1, the base end of the rear surface of each of which is partially pasted. The sticky notes H1 can be separated from the sticky note bundle H one by one and can be adhered to a notebook via the paste portion H1*b* of the base end thereof after separation.

The sticky note printer 2 includes the sticky note holder 21 for storing the sticky note bundle H, a sticky note feed device 22 (paper feed device) for lifting up an uppermost sticky note H1 of the sticky note bundle H, separating the sticky note H1, and feeding the sticky note H1 toward the ejection slot 12, a print device 23 for performing printing on the fed sticky note H1 with the thermal head 31 (print head) and the platen roller 32, a ribbon feed device 24 for feeding the ink ribbon R provided for the printing, and a disjunction device 25 for disjunct the platen roller 32 to/from the thermal head 31, all of which are mounted in the device casing 11. The sticky note printer 2 further includes a detection sensor 26 (detection device) for detecting the separation of the platen roller 32 from the thermal head 31.

The sticky note holder 21 includes a sticky note bundle casing 41 having an open surface and formed in a box shape and a mounting stage 42 which is mounted in the sticky note bundle casing 41 so as to horizontally mount the sticky note bundle H. A coil spring 43 for biasing the mounting stage 42 upwardly is interposed between the mounting stage 42 and the bottom surface of the sticky note bundle casing 41. The sticky note holder 21 is mounted in the device casing 11 in the draw-out type and is detachably mounted via the sticky note insertion opening 13. Accordingly, when the sticky note bundle H is to be replaced or exchanged, the sticky note holder 21 is drawn out and the sticky note bundle H is inserted.

The sticky note bundle casing 41 includes a surrounding frame-like casing body 44 for guiding the mounting stage 42 and position regulation units 45 which are provided at the upper end of the casing body 44 and protrudes inward so as to press a front end Ha and a base end Hb of the sticky note bundle H.

The mounting stage 42 is formed in a flat plate shape and is biased upwardly by the coil spring 43. The sticky note bundle H is stored therein such that the height of the sticky note H1 located at the uppermost position is constantly maintained by the position regulation units 45 although the sticky notes H1 are fed one by one. At this time, the position of the sticky note bundle H stored therein becomes a pickup position 101 where the sticky note H1 at the uppermost position is lifted up by the sticky note feed device 22.

Accordingly, when the sticky note bundle H is stored on the mounting stage 42 from the top of the sticky note bundle casing 41, the sticky note bundle H is biased upward by the coil spring 43 and the front end Ha and the base end Hb are regulated to be positioned at the pickup position 101 by the position regulation unit 45 in a state that the stick notes are mounted horizontally.

The sticky note feed device 22 includes a feed roller 51, a driven roller 52, a rotation arm 53, a driving motor 54, and a deceleration gear train 55 (power transmitting device). The feed roller 51 rolling-contacts the uppermost sticky note H1 of the sticky note bundle H located at the pickup position 101, lifts up and separates the sticky note H1, and inserting the turned-up sticky note H1 between the driven roller 52 and the feed roller 51. The rotation arm 53 moves the feed roller 51 between the pickup position 101 for lifting up the sticky note H1 and the insertion position 102 for inserting the sticky note between the driven roller 52 and the feed roller 51. The driving motor is a driving source of the feed roller 51 and the rotation arm 53 and the deceleration gear train 55 transmits a driving force of the driving motor 54 to the feed roller 51 and the rotation arm 53. The driving motor 54 includes a counter 56 for measuring the feed amount of the sticky notes H1 to increase the feed amount of the sticky notes H1 one by one.

The feed roller 51 rolling-contacts the rear surface of the free end H1*a* of the turned-up sticky note H1 and separates, rotates and feeds the sticky note H1 at the insertion position 102, and has a roller body 61 which directly rolling-contacts the sticky note H1 and a roller driving shaft 62 which is a central shaft for rotating the roller body 61. Both sides of the roller driving shaft 62 are rotatably held at corresponding sides of the rotation arm 53 and the roller driving shaft 62 is rotated by the driving force of the driving motor 54 transmitted via the deceleration gear train 55.

The rotation arm 53 rotatably holds the roller driving shaft 62 at the front end thereof and is rotated around the base end. The rotation arm 53 is moved between the pickup position 101 and the insertion position 102 by the driving force of the driving motor 54 transmitted via the deceleration gear train 55.

The print device 23 has the thermal head 31 arranged in the vicinity of the ejection slot 12 and having the same width as the feed roller 51 and the platen roller 32 which faces the thermal head 31. The platen roller 32 extends in the width direction of the sticky note H1. When the feed roller 51 is moved to the insertion position 102, the platen roller 32 is rotated by the driving force from the driving motor 54 via the deceleration gear train 55 and performs the printing using the thermal head 31 while applying a feed force to the received sticky note H1. Accordingly, it is possible to stably perform the printing on the sticky note H1. The platen roller 32 is moved between a contact position 103 which contacts the thermal head 31 and a separation position 104 which is separated from the thermal head 31, by the below-described disjunction device 25 (see FIGS. 9E and 9G). The print device 23 having the above-described configuration performs the printing on the sticky note H1 while controlling the thermal head 31 and the driving motor 54 using the control signal from the personal computer 4.

The ribbon feed device 24 has the ribbon cartridge C and a ribbon winding shaft 71 for winding the ink ribbon R of the mounted ribbon cartridge C. The ribbon winding shaft 71 is rotated by the driving force from the driving motor 54 via the deceleration gear train 55 when the feed roller 51 is moved to the insertion position 102 and the platen roller 32 is moved to the contact position 103. The ribbon cartridge C includes a ribbon dispensing reel 72 around which the ink ribbon R is wound such that the ink ribbon may be freely dispensed, a ribbon winding reel 73 for winding the ink ribbon R, and a cartridge casing (not shown) for rotatably receiving the reels therein.

When the openable cover 14 is opened and the ribbon cartridge C is mounted, the ink ribbon R is inserted between the thermal head 31 and the platen roller 32 and the ribbon winding reel 73 is pivotally supported by the ribbon winding shaft 71. When the printing is started by the print device 23, the ribbon winding shaft 71 starts the winding (feed) of the ink ribbon R along with the feed of the sticky note H1.

The disjunction device 25 includes a support arm 81 for supporting the platen roller 32, a plate cam 82 for pressing the upper end surface of the support arm 81 downwardly, and a disjunction motor 83 for rotating the plate cam 82. The disjunction motor 83 is controlled by the personal computer 4. The support arm 81 is pulled up by a return spring (not shown) such that the platen roller 32 is made to approach the contact position 103, and a platen shaft portion which protrudes in the width direction of the sticky note H1 and supports the platen roller 32 is provided on the side surface of the support arm 81. The base end of the support arm 81 is rotatably supported by a rotation support shaft 84 fixed to the device casing 11.

Figure 4:
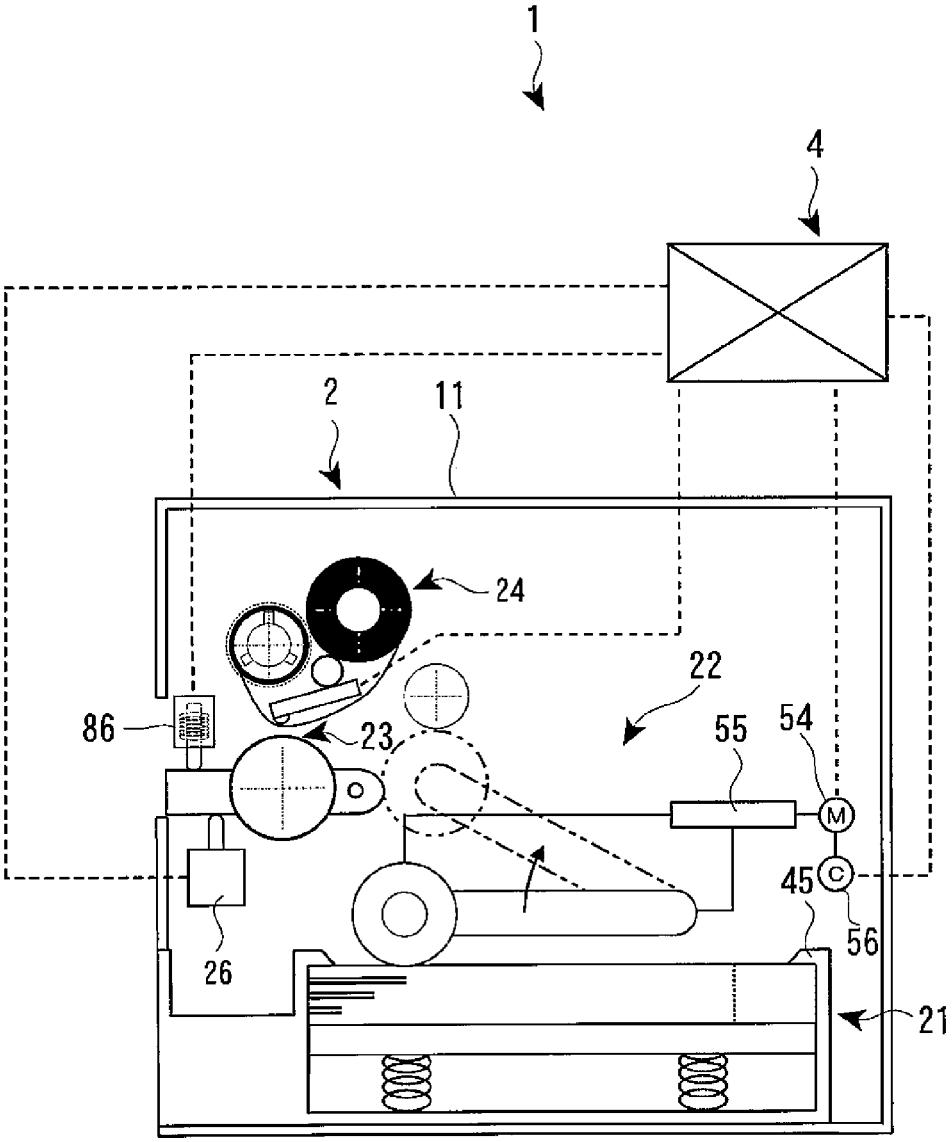
FIG. 4 is a schematic view showing another example of the cross section of the sticky note printer.

When the disjunction motor 83 is driven, the plate cam 82 is half-rotated such that a protrusion thereof presses the upper end surface of the support arm 81 downwardly, and the platen roller 32 is made to approach the separation position 104. Thereafter, when the plate cam 82 is half-rotated, the protrusion of the plate cam 82 is moved upward and the platen roller 32 is returned to the contact position 103 by the return spring. The platen roller 32 is rotated between the contact position 103 and the separation position 104 around the base end of the support arm 81. Instead of the plate cam 82 and the disjunction motor 83, a solenoid 86 may disjunct the platen roller 32 to/from the thermal head 31 (see FIG. 4). In this case, the solenoid 86 is controlled by the personal computer 4 and is configured to press the upper end surface of the support arm 81 downwardly.

Figure 5A:
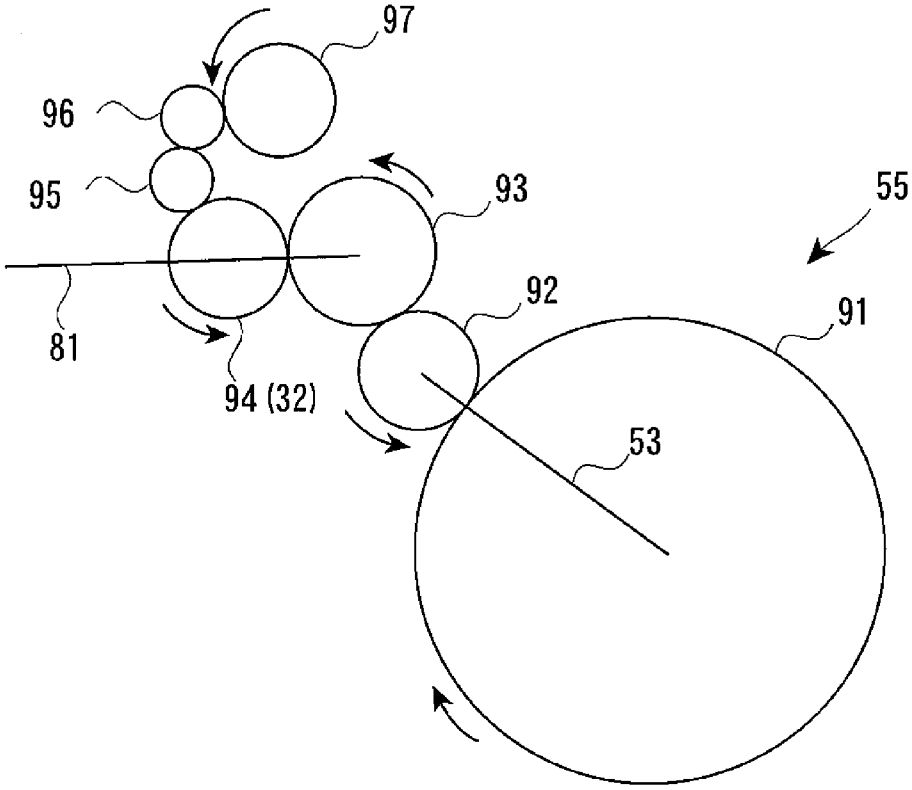
FIGS. 5A and 5B are schematic views showing a clutch device and a deceleration gear train.

Now, the gear train structure (deceleration gear train 55) of the ribbon feed device 24 and the platen roller 32 will be described in detail with reference to FIG. 5A. The deceleration gear train 55 transmits the driving force of the driving motor 54 to the feed roller 51, the rotation arm 53, the platen roller 32, and the ribbon winding shaft 71 and includes planetary gears. The deceleration gear train 55 includes a major sun gear 91 which is rotated by the driving force of the driving motor 54 and has a largest diameter, a first planetary gear 92 engaged with the major sun gear 91, a first intermediate gear 93 which disjunct from the first planetary gear 92, a second planetary gear 94 engaged with the first intermediate gear 93 using the first intermediate gear 93 as a sun gear, a second intermediate gear 95 which disjunct from the second planetary gear 94, a third intermediate gear 96 engaged with the second intermediate gear 95, and a fourth intermediate gear 97 engaged with the third intermediate gear 96.

The major sun gear 91 is provided on the same shaft as the base end of the rotation arm 53 and the first planetary gear 92 outputs the driving force to the feed roller 51 provided on the same shaft. One side of the rotation arm 53 becomes a carrier of the first planetary gear 92 having the same shaft as the major sun gear 91. That is, a position where the first planetary gear 92 is engaged with the first intermediate gear 93 becomes the insertion position where the feed roller 51 contacts the driven roller 52 and a position where the first planetary gear 92 is separated from the first intermediate gear 93 and the rotation arm 53 becomes horizontal becomes the pickup position 101. Accordingly, the rotation arm 53 is rotated between the pickup position 101 and the insertion position 102 such that the feed roller 51 is rotated and is moved. The rotation of the rotation arm 53 is performed by an end surface cam not shown in the figure using the driving motor 54 as a driving source.

The first intermediate gear 93 is provided on the same shaft as the rotation support shaft 84 for supporting the support arm 81, and the second planetary gear 94 outputs the driving force to the platen roller 32 provided on the same shaft. A portion of the support arm 81 becomes a carrier of the second planetary gear 94 having the same shaft as the first intermediate gear 93. That is, a position where the second planetary gear 94 is engaged with the second intermediate gear 95 becomes the contact position 102 where the platen roller 32 contacts the thermal head 31, and a position where the second planetary gear 94 is separated from the second intermediate gear 95 becomes the separation position 104. Accordingly, the platen roller 32 is rotated at the contact position 103 and the separation position 104.

The driving force transmitted to the second intermediate gear 95 is transmitted to the fourth intermediate gear 97 via the third intermediate gear 96 and the fourth intermediate gear 97 outputs the driving force to the ribbon winding shaft 71 provided on the same shaft. That is, the driving force is indirectly input from the second intermediate gear 95 to the ribbon winding shaft 71. Since the fourth intermediate gear 97 adjusts a rotation direction, the ribbon winding shaft 71 is not limited to this configuration. The configuration in which the driving force is directly input from the second intermediate gear 95 to the ribbon winding shaft 71, that is, the configuration in which the ribbon winding shaft 71 is provided on the same shaft as the second intermediate gear 95, may be used.

Figure 5B:
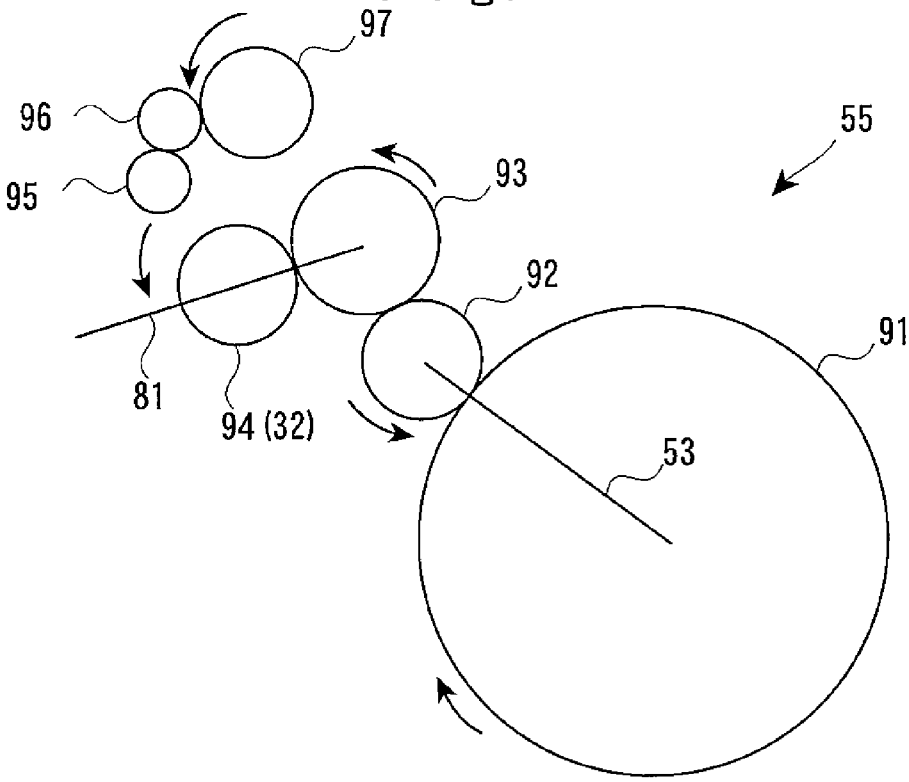

When the driving motor 54 is rotated in a state that the platen roller 32 is made to approach the contact position 103, the feed roller 51 located at the pickup position 101 is moved to the insertion position 102 while rotating. When the feed roller 51 is made to approach the insertion position 102, the first planetary gear 92 is connected to the first intermediate gear 93 such that the driving force of the driving motor 54 is transmitted to the platen roller 32 and the driving force is transmitted to the ribbon winding shaft 71 via the second intermediate gear 95 and the third intermediate gear 96. In contrast, in a state that the platen roller 32 is located in the separation position 104 (see FIG. 5B), the second planetary gear 94 is separated from the second intermediate gear 95 and the driving force is not transmitted to the ribbon winding shaft 71. Accordingly, when the platen roller 32 is separated from the contact position 103, the winding of the ink ribbon R by the ribbon feed device 24 is stopped. That is, a clutch device described in claims corresponds to the second planetary gear 94.

The detection sensor 26 is provided below the support arm 81 and includes a micro-switch. Accordingly, when the support arm 81 is moved downwardly via the plate cam 82 such that the platen roller 32 is made to approach the separation position 104, the lower end surface of the support arm 82 contacts the front end of the detection sensor 26 and detects the movement of the platen roller 32 to the separation position 104. By this configuration, the sticky note H1 is not idly fed in a state that the thermal head 31 and the platen roller 32 contact each other, due to mechanical failure. The detection sensor 26 is not limited to the micro-switch and an optical sensor such as a photo-interrupter may be used.

Figure 6:
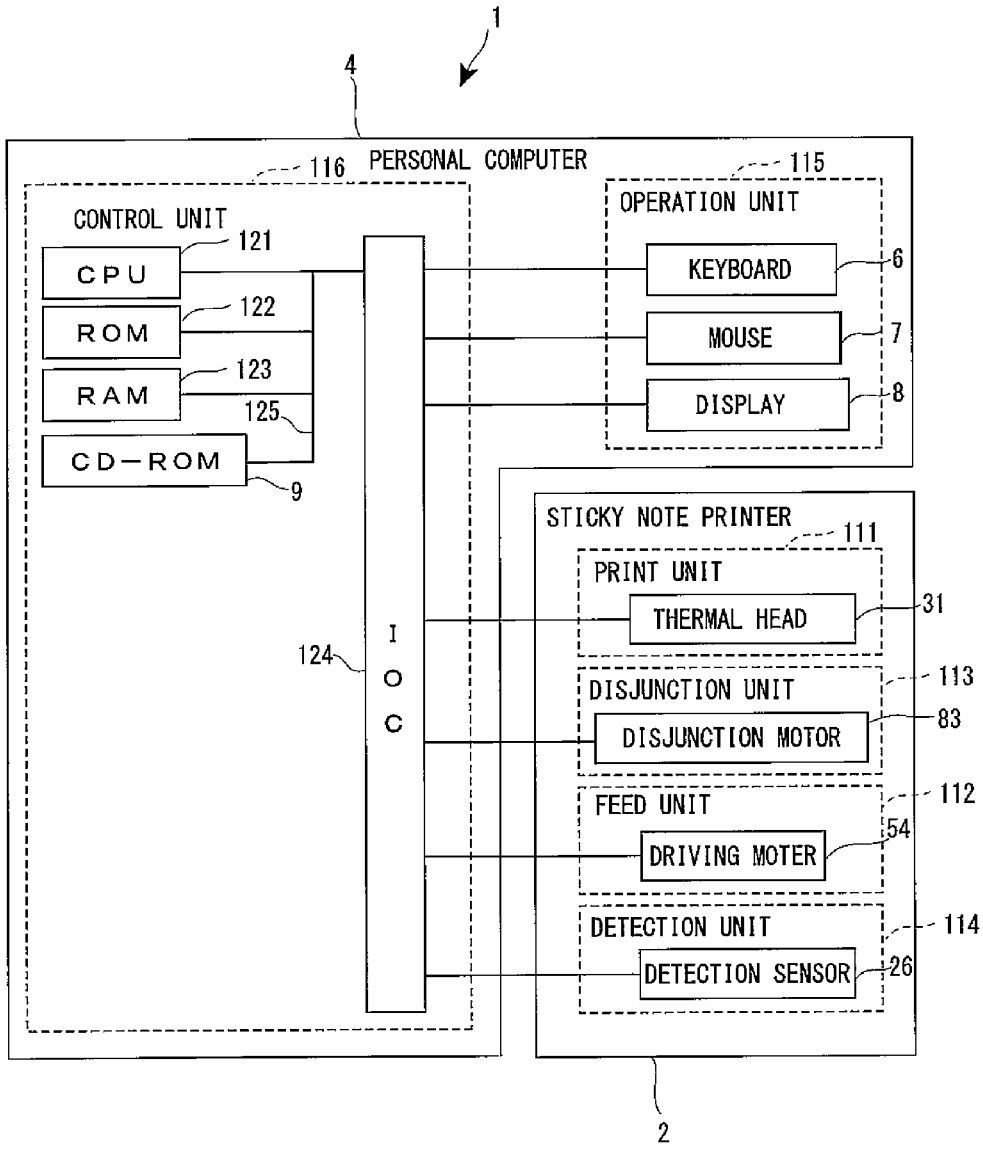
FIG. 6 is a control block diagram of the sticky note print system.

Now, a control system of the sticky note print system 1 will be described with reference to FIG. 6. The sticky note print system 1 controls the information process and a variety of drives of the sticky note printer 2 by the personal computer 4. The sticky note printer 2 includes a print unit 111 for performing the print using the thermal head 31, a feed unit 112 for separating a sticky note H1 from the sticky note bundle H and sending the sticky note to the outside of the device, a disjunction unit 113 for moving the platen roller 32 between the contact position 103 and the separation position 104 using the disjunction motor 83, and a detection unit 114 for detecting the movement of the platen roller 32 to the separation position 104 using the detection sensor 26. The personal computer 4 includes a operation unit 115 and a control unit 116. The operation unit 115 functions as a user interface for inputting data via the keyboard 6 and the mouse 7 or displaying a variety of information on the display 8. The control unit 116 controls the information process of the sticky note printer 2, the operation unit 115 and the units and controls the entire sticky note print system 1. The personal computer 4 includes a non-print section acquiring device for acquiring non-contact section data from print data and a feed amount calculation device for calculating the feed amount of sticky notes on the basis of the print dot number of the print data from a time point when the sticky note feed device starts to feed the sticky note. The non-print section acquiring device and the feed amount calculation device configure the main unit by the control unit 116.

The control unit 116 includes a central processing unit (CPU) 121, a read only memory (ROM) 122, a random access memory (RAM) 123, a CD-ROM 9, and an input/output controller (IOC) 124, all of which are connected to one another by an internal bus 125. When a variety of signal data is input from each unit of the sticky note print system 1 via the IOC 124, the CPU 121 processes the variety of data in the RAM 123 on the basis of the input variety of signal data according to the application software stored in the CD-ROM 9 and outputs a variety of signal data to each unit of the sticky note print system 1 via the IOC 124.

Figure 7A:
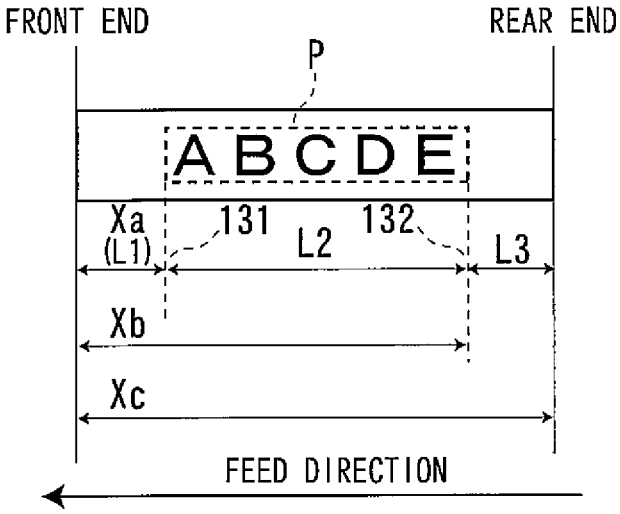
FIG. 7A is a view showing non-print section data indicating a single non-print section of a character image and FIG. 7B is a view showing non-print section data indicating a plurality of non-print sections of a character image.

Now, a configuration for acquiring (converting) the non-print section data of a character image P from print data by the non-print section acquiring device will be described with reference to FIG. 7A. The print data includes the character image P and positional data of the character image P. A front blank dot number L1 from the front end of the sticky note H1 to a print start position 131 where the print of an initial character image P starts and a back blank dot number L3 from a print end position 132 where the printing of a last character image P is completed to the back end of the sticky note H1 are acquired from the positional data of the character image P. The value of the front blank dot number L1 becomes a print start dot number Xa in which the printing starts with respect to the sticky note H1. Next, a character print dot number L2 corresponding to a print section is acquired from the length of the feed direction of the character image P, the character print dot number L2 and the front blank dot number L1 are added to calculate a print end dot number Xb in which the printing is completed with respect to the sticky note H1. The front blank dot number L1, the character print dot number L2 and the back blank dot number L3 are added to calculate a total feed dot number Xc from the front end to the back end of the sticky note H1. That is, the print start dot number Xa from a time point when the front end of the feed direction of the sticky note H1 is made to approach the thermal head 31 to a time point when the print start position 131 is made to approach the thermal head 31 and a value (Xc−Xb) obtained by subtracting the print end dot number Xb from the total feed dot number Xc from a time point when the print end position 132 is made to approach the thermal head 31 to a time point when the sticky note H1 is ejected becomes the non-print section data.

Figure 8:
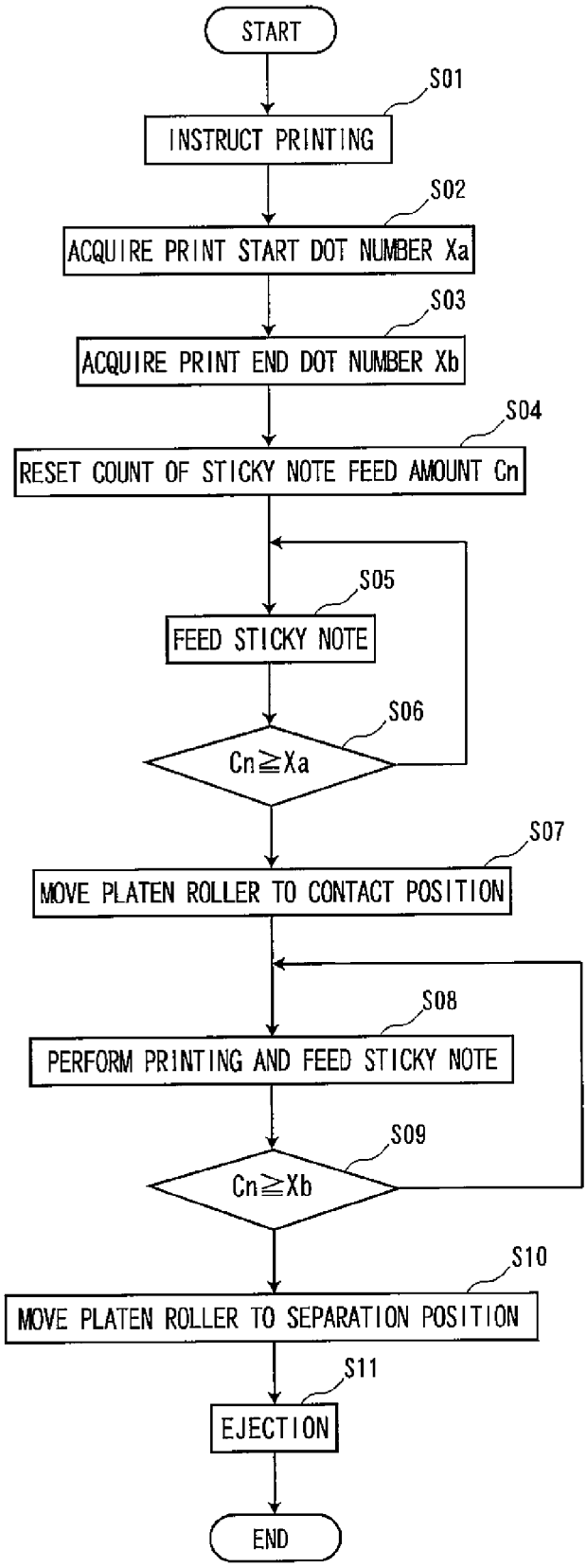
FIG. 8 is a flowchart showing a print process using the sticky note print system.

Now, a control flow will be described with reference to FIG. 8. When a user instructs the print (S01), the platen roller 32 is moved to the separation position 104 and the print start dot number Xa and the print end dot number Xb are acquired by the non-print section acquiring device (S02 and S03). The note is fed by the sticky note feed device 22 until the front end of the sticky note H1 is made to approach the thermal head 31 and the count Cn of the counter 56 of the sticky note feed device 22 is reset (S04). At this time, the counter 56 increases the feed amount of one dot of the sticky note H1 one by one (S05). The sticky note feed device 22 feeds the sticky note H1 until the count Cn reaches the print start dot number Xa (S06). That is, the sticky note H1 is fed in a state that the platen roller 32 and the thermal head 31 are opened a duration from a time point when the front end of the sticky note H1 is made to approach the thermal head 31 to a time point when the printing starts with respect to the sticky note H1. When the platen roller 32 is located at the separation position 104 as described above, the driving force of the driving motor 54 is not transmitted to the ribbon winding shaft 71 and thus the feed of the ink ribbon R is stopped.

Subsequently, when the count Cn exceeds the print start dot number Xa, the disjunction device 25 moves the platen roller 32 to the contact position 103 (S07). Then, the print and the feed of the sticky note are performed (S08). The sticky note feed device 22 feeds the sticky note H1 while printing until the count Cn reaches the print end dot number Xb (S09). That is, the sticky note H1 is sent in a state the sticky note H1 is inserted between the platen roller 32 and the thermal head 31 from the print start to the print end of the sticky note H1. At this time, since the platen roller 32 is located at the contact position 103, the driving force of the driving motor 54 is transmitted to the ribbon winding shaft 71 and thus the ink ribbon R feeds along with the sticky note H1.

When the count Cn exceeds the print end dot number Xb, the disjunction device 25 moves the platen roller 32 to the separation position 104 (S10). Accordingly, the platen roller 32 and the thermal head 31 are opened and thus the feed of the ink ribbon R is stopped. In this state, the sticky note H1 is fed until the count Cn reaches the total feed dot number Xc and is ejected via the ejection slot 12 (S11). If the front blank dot number L1 and the back blank dot number L3 do not reach predetermined setting values (dot numbers), the thermal head 31 and the platen roller 32 may be controlled not to contact and separated to/from each other.

Next, a series of operations for performing the printing and feed of the sticky note H1 on the basis of the print control will be described with reference to FIG. 9. In a print standby state, the feed roller 51 is located at the pickup position 101 to rolling-contact the surface of the uppermost sticky note H1 of the sticky note bundle H stored in the sticky note holder 21 (see FIG. 9A).

Figures 9A, 9B, 9C, 9D, 9E, 9F, 9G, 9H:
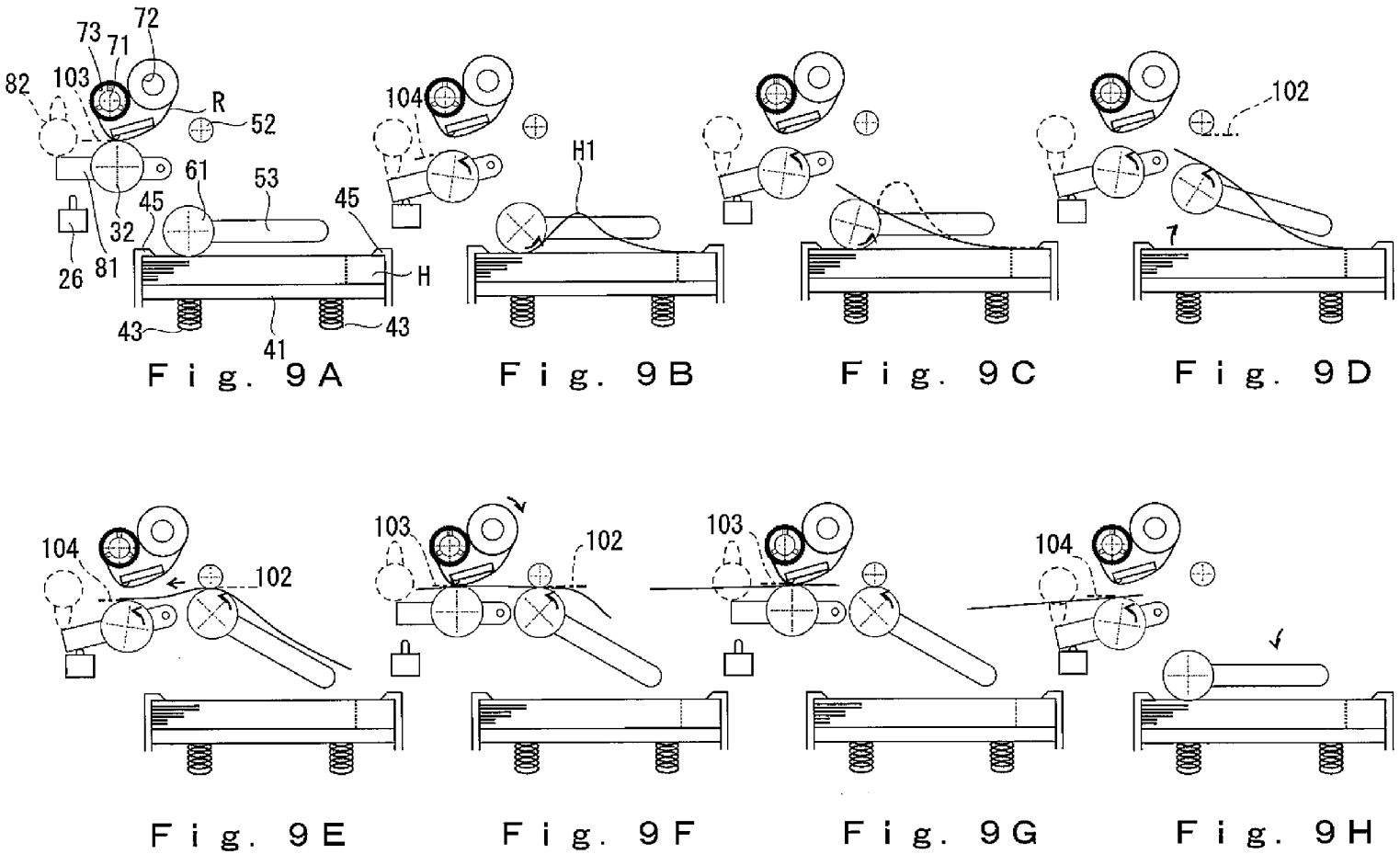
FIGS. 9A to 9H are views showing a series of operations of the sticky note printer.

Next, when the protrusion of the plate cam 82 is moved downwardly to press the support arm 81 and the detection sensor 26 detects that the platen roller 32 is moved to the separation position 104, the feed roller 51 is rotated and the turn-up operation of the sticky note H1 is started (see FIG. 9B). When the feed roller 51 rolling-contacting the free end H1*a* of the surface of the sticky note H1 is rotated, the middle portion of the longitudinal direction of the sticky note H1 is curved upwardly and thus the sticky note H1 is lifted up. When the support arm 81 is pressed, the driving force is blocked from being transmitted to the ribbon winding shaft 71.

When the feed roller 51 is moved upwardly while rotating to be separated from the sticky note bundle H immediately after the front end of the turned-up sticky note H1 passes through the lower side of the feed roller 51, the sticky note H1 springs over the feed roller 51 by the rotation force of the feed roller 51 and the free end H1*a* of the sticky note H1 rides on the feed roller 51 (see FIG. 9C).

Subsequently, the feed roller 51 on which the sticky note H1 is laid is moved to (goes around) the insertion position 102 (see FIG. 9D). When the feed roller 51 reaches the insertion position 102 such that the sticky note H1 is inserted between the driven roller 52 and the feed roller 51, the feed roller 51 separates the turned-up sticky note H1 from the sticky note bundle H and the separated sticky note H1 is fed to the thermal head 31 by the feed roller 51 and the platen roller 32 (see FIG. 9E).

When the print section (print start position 131) of the sticky note H1 approaches the thermal head 31, the protrusion of the plate cam 82 is moved upwardly, the support arm 81 is pulled up by a return spring, the platen roller 32 contacts the thermal head 31, and the printing on the sticky note H1 starts (see FIG. 9F).

When the non-print section (print end position 132) of the sticky note approaches the thermal head 31 (see FIG. 9G), the protrusion of the plate cam 82 is moved downwardly again to press the support arm 81. Then, the sticky note H1 which the printing is completed is fed to the ejection slot 12 by the feed roller 51 and the platen roller 32.

At a time point when the paste portion H1*b* of the sticky note H1 reaches the platen roller 32, the feed roller 51 is moved downwardly from the insertion position 102 to the pickup position 101 (see FIG. 9H). Thereafter, the user removes the sticky note H1 ejected via the ejection slot 12 to obtain the printed sticky note H1.

In the sticky note print system 1 according to the present embodiment, when a plurality of non-print sections of the feed direction of the sticky note H1 approach the thermal head 31, the space between the thermal head 31 and the platen roller 32 is opened and the sticky note H1 is fed in a state that the ink ribbon R is stopped. Accordingly, since the ink ribbon R is not fed in the non-print section, the waste of the ink ribbon R corresponding to the length of the plurality of non-print sections can be suppressed and the running cost of the user can be reduced. Since the sticky note H1 and the ink ribbon R are fed in a state that the stick note H1 and the ink ribbon R are separated from each other, the surface of the sticky note H1 is not contaminated by friction between the sticky note H1 and the ink ribbon R or the ink ribbon R is not forcedly extracted. Even when the sticky note bundle H is stored to be reversed by mistake, the paste portion H1*b* of the sticky note H1 can be fed in a state of being separated from the ink ribbon R by setting the blank (non-print section) of the feed direction of the sticky note H1 to be wider than the paste portion H1*b* of one end of the sticky note H1.

The feed amount calculating device may calculate the feed amount of the sticky notes by calculating the rotation amount of the motor or the feed speed and time of the sticky note H1, in addition to the print dot number. When the management is performed by the rotation amount of the motor, the control can be easily performed using a stepping motor or an encoder-equipped motor as the driving motor 54. When the management is performed by the feed speed and the feed time, the feed distance of the sticky note H1 is calculated by the feed speed and the feed time and the control can be performed on the basis of the feed distance.

Figure 7B:
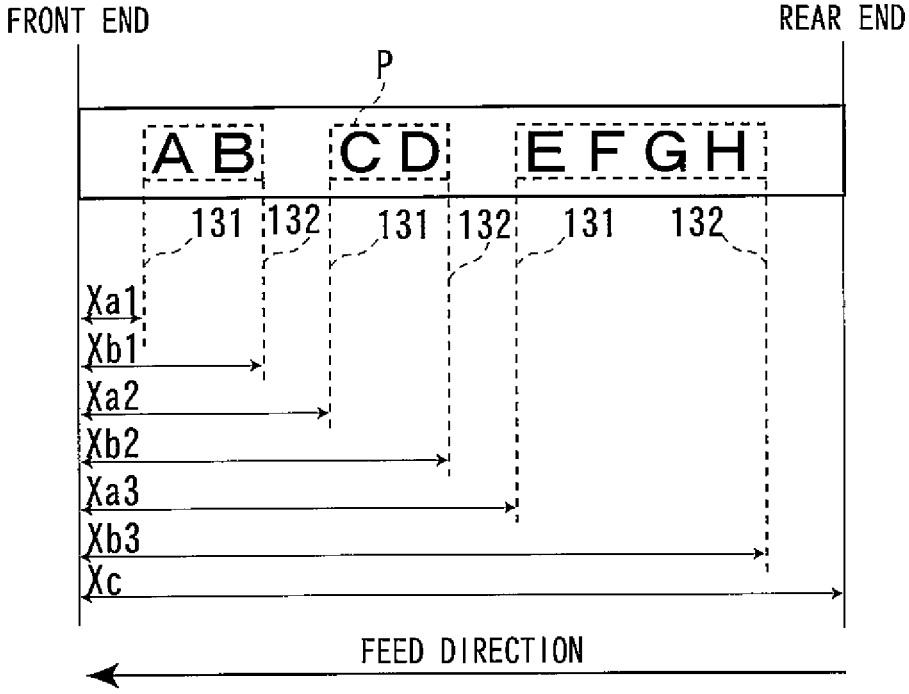

As shown in FIG. 7B, acquisition (conversion) of non-print section data when a plurality (three in the present embodiment) of character images P is printed on the sticky note H1 will be described. In this case, the print start dot numbers Xa1, Xa2 and Xa3 from the front end of the sticky note H1 to the start of the print of the initial character images P and the print end dot numbers Xb1, Xb2 and Xb3 are calculated with respect to the character images P from the positional data of the character images P. That is, in this case, Xa1 corresponding to the value of the front blank dot number, Xa2-Xb1 and Xa3-Xb2 corresponding to the values of the non-print section dot numbers of the character images P, and Xc-Xb3 corresponding to the value of the back blank dot number become the non-print section data. When the non-print section data does not reach a predetermined setting value (dot number), the thermal head 31 and the platen roller 32 may be controlled not to contact and separated to/from each other.

Although the sticky note bundle H is used in the present embodiment, a memo pad of which the fixed end surface is adhered may be used. Although the platen roller 32 is moved in the present embodiment, the thermal head 31 may move. When the ribbon feed device 24 is driven by another driving force, the driving force of the ribbon feed device 24 may be stopped on the basis of the detection of the detection sensor 26.

The units (functions) of the sticky note print system 1 may be provided as a program. The program may be stored in a recording medium (not shown). As the recording medium, a CD-ROM, a flash ROM, a memory card (Compact Flash (registered trademark), Smart Media, Memory stick, or the like), an optical magnetic disk, a digital versatile disk, and a flexible disk may be used.

Figure 10:
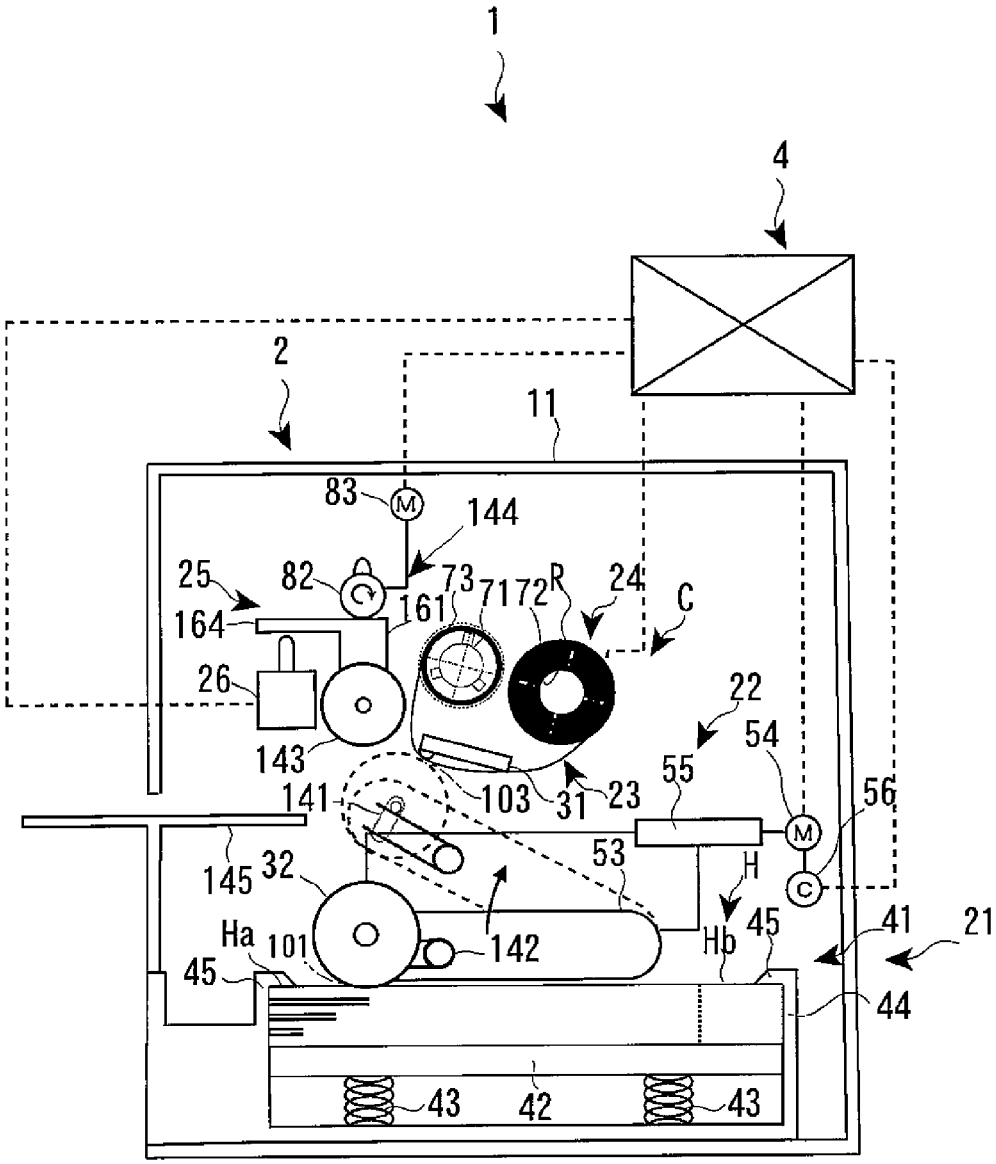
FIG. 10 is a schematic view showing an example of the cross section of a sticky note printer according to a second embodiment.

Next, a sticky note print system 1 according to a second embodiment will be described with reference to FIG. 10. In order to avoid duplicated description, only different portions will be described. In the sticky note print system 1, unlike the sticky note printer 2 according to the second embodiment, a platen roller 32 functions as the feed roller 51 and a presser roller 143 for retracting the platen roller 32 from the contact position is included. A rotation arm 53 includes a bearing portion 141 formed of an elongated opening and an energizing spring 142 for energizing the platen roller 32 to the contact position 103 in contact with a roller driving shaft 62. A disjunction device 25 is provided in the vicinity of an ejection slot 12, rolling-contacts the platen roller 32, and includes a presser roller 143 for positioning the platen roller 32 at a separation position 104, a roller movement device 144 for disjunct the presser roller 143 to/from the platen roller 32, and the energizing spring 142. A reception portion 145 which extends from the inside to the outside of the casing with the ejection slot 12 as a boundary therebetween and receives the sticky note H1 from the platen roller 32 is formed at the front surface of the device casing 11.

The roller movement device 144 is configured such that the presser roller 143 is made to approach a pressing position 151 (see FIG. 11E) on a movement locus of the platen roller 32 which is moved between the pickup position 101 and the contact position 103 and includes a movement rod 161 for supporting the presser roller 143, a plate cam 82 for pressing the upper end surface of the movement rod 161 downwardly, a disjunction motor 83 for rotating the plate cam 82. The disjunction motor 83 is controlled by a personal computer 4. The movement rod 161 is pulled up by a return spring (not shown) such that the presser roller 143 is made to approach a pressing release position 152 (see FIG. 11F) shifted from the movement locus of the platen roller 32. A detection boss 164 for switching a detection sensor 26 is formed on the movement rod 161.

Figures 11A, 11B, 11C, 11D, 11E, 11F, 11G, 11H:
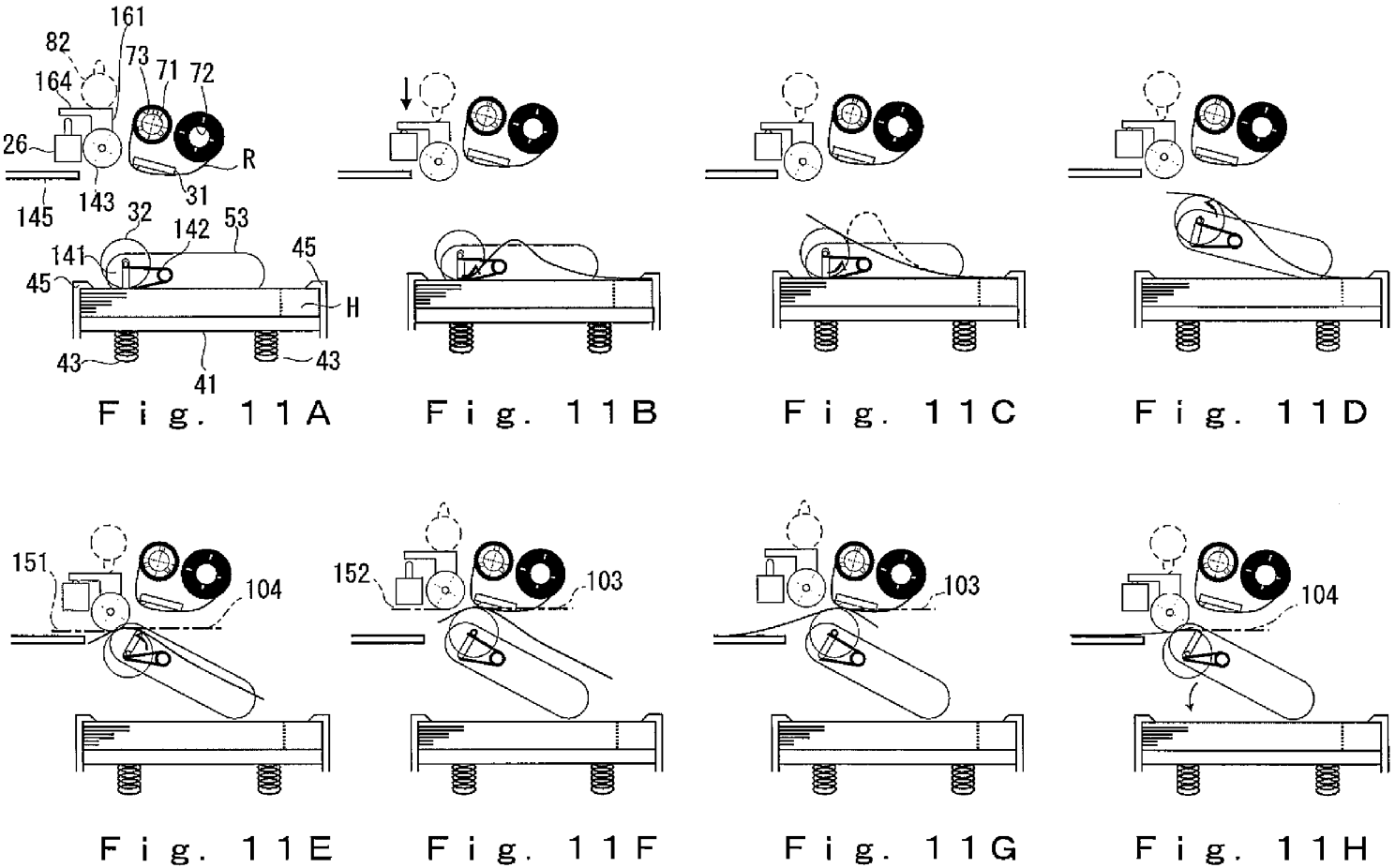
FIGS. 11A to 11H are views showing a series of operations of the sticky note printer according to the second embodiment.

When the movement rod 161 is pressed such that the presser roller 143 is made to approach the pressing position 151, the platen roller 132 slidably is moved to the lower side of the bearing portion 141 against the energizing spring 142 to be positioned at the separation position 104 (see FIG. 11E). When the movement rod 161 is pulled up such that the presser roller 143 is made to approach the pressing release position 152, the platen roller 32 slidably is moved to the upper side of the bearing portion 141 by the energization of the energizing spring 142 such that the plate roller 32 is made to approach the contact position 103 (see FIG. 11F).

A series of operations for performing the printing and feed of a sticky note H1 will be described with reference to FIG. 11. In a print standby state, the platen roller 32 is located at the pickup position 101 and rolling contacts the surface of an uppermost sticky note H1 of the sticky note bundle H stored in a sticky note holder 21 (see FIG. 11A). The presser roller 143 is located at the pressing release position 152 and is separated from the platen roller 32.

Next, when the protrusion of the plate cam 82 presses the presser roller 143 via the movement rod 161, the detection boss 164 presses the detection sensor 26. The personal computer 4 rotates the platen roller 32 and starts the turn-up operation of the sticky note H1 when the detection sensor 26 detects the movement of the platen roller 32 to the separation position 104 (see FIG. 11B). When the presser roller 143 is pressed, the driving force is blocked from being transmitted to a ribbon winding shaft 71.

When the platen roller 32 is rotated, the sticky note H1 springs over the platen roller 32 and thus the front end of the sticky note H1 rides on the platen roller 32 (see FIG. 11C).

Subsequently, the platen roller 32 on which the sticky note H1 is laid is moved (goes) upwardly toward the contact position 103 while rotating (see FIG. 11E). Then, the platen roller 32 is in contact with the presser roller 143 which is moved to the pressing position 152 to be positioned at the separation position 104. When the platen roller 32 reaches the separation position 104 and the sticky note H1 is inserted between the presser roller 143 and the platen roller 32, the platen roller 32 separates the turned-up sticky note H1 from the sticky note bundle H and the separated sticky note H1 is fed toward the ejection slot 12 (see FIG. 11E).

When the print section (print start position 131) of the sticky note H1 is made to approach the thermal head 31, the protrusion of the plate cam 82 is moved upwardly to pull up the presser roller 143 via the movement rod 161 by the return spring, the platen roller 32 contacts the thermal head 31, and the printing on the sticky note H1 starts (see FIG. 11F).

When the non-print section (print end position 132) of the sticky note H1 is made to approach the thermal head 31 (see FIG. 11G), the protrusion of the plate cam 82 is moved downwardly again and presses the presser roller 143. The sticky note H1 on which the printing is completed is inserted between the presser roller 143 and the platen roller 32 and is fed to the ejection slot 12.

At a time point when a paste portion H1*b* of the sticky note H1 reaches the platen roller 32 (see FIG. 11H), the platen roller 32 is moved toward the pickup position 101 and the sticky note H1 is sent to the reception portion 145. Thereafter, a user removes the sticky note H1 ejected via the ejection slot 12 to obtain the sticky note H1.

What is claimed is:

1. A print system comprising:

a paper feed device which feeds paper having a paste portion in a state that the paste portion faces backward in a feed direction of the paper;

a print device which has a platen roller and a print head and inserts the fed paper and an ink ribbon at a head position between the platen roller and the print head to perform printing;

a disjunction device which relatively moves the platen roller with respect to the print head between a contact position where the platen roller contacts the print head and a separation position where the platen roller does not contact the print head; and a print control device which controls the paper feed device, the print device, and the disjunction device, wherein the paper is a sticky note that is separated from a bundle of sticky notes including a plurality of sticky notes one end of which is respectively pasted, the paper feed device has a feed roller that moves between a pickup position for lifting up the sticky note and an insertion position for inserting the sticky note with a driven roller, the platen roller rotates when the feed roller moves to the insertion position, and the print control device relatively moves the platen roller to the separation position and moves the feed roller to the pickup position for a period during which the paste portion of the fed paper passes through the platen roller position.

2. The print system according to claim 1, further comprising:

a detection device which detects that the platen roller has relatively moved to the separation position with respect to the print head; and a ribbon feed device which feeds the ink ribbon along with the fed paper, wherein the print control device controls the ribbon feed device to stop the feed of the ink ribbon when the detection device detects that the platen roller has relatively moved to the separation position.

3. The print system according to claim 2, wherein the ribbon feed device includes:

a ribbon winding shaft on which the ink ribbon is wound;

a driving device which is a driving source; and a clutch device which transmits a driving force of the driving device to the ribbon winding shaft or blocks the driving force from being transmitted to the ribbon winding shaft according to the movement of the platen roller, wherein the clutch device separates the platen roller from the contact position with the disjunction device and blocks the driving force to stop the feed of the ink ribbon.

4. The print system according to claim 2, comprising:

a paper printer including the paper feed device, the ribbon feed device, the print device, the disjunction device, and the detection device; and an information processing terminal which includes the print control device, and the feed amount calculating device, connects to the paper printer, and performs an information process including control of the paper printer.

5. The print system according to claim 1, further comprising: a non-print section acquiring device which acquires non-print section data of a character image in a feed direction of the paper from print data including the character image having at least one character printed on the paper, positional data of the character image on the paper, and paste portion data of the paper, wherein the print control device controls the disjunction device to move relatively the platen roller to the separation position based on the non-print section data.

6. The print system according to claim 5, further comprising a feed amount calculating device which calculates a paper feed amount from a time point when the paper feed device starts to feed the paper, on the basis of the non-print section data, wherein the print control device controls the non-print section to approach the print head, on the basis of the calculated paper feed amount.

7. The print system according to claim 6, wherein the feed amount calculating device calculates the paper feed amount from a print dot number.

8. The print system according to claim 6, wherein the paper feed device has any one of a stepping motor and an encoder-equipped motor, wherein the feed amount calculating device calculates the paper feed amount from a rotation amount of the motor.

9. The print system according to claim 6, wherein the feed amount calculating device calculates the paper feed amount from a paper feed speed and a paper feed time of the paper feed device.

10. The print system according to claim 6, wherein a plurality of non-print sections include at least one of a front blank section and a back blank section of the paper.

11. A method of controlling a print system including a paper feed device having a feed roller which feeds paper having a paste portion in a state that the paste portion faces backward in a feed direction of the paper, wherein the paper is a sticky note that is separated from a bundle of sticky notes including a plurality of sticky notes one end of which is respectively pasted; a print device which has a platen roller and a print head and inserts the fed paper and an ink ribbon at a head position between the platen roller and the print head to perform printing; and a disjunction device which relatively moves the platen roller with respect to the print head between a contact position where the platen roller contacts the print head and a separation position where the platen roller is separated from the print head; the method comprising:

moving the feed roller between a pickup position for lifting up the sticky note and an insertion position for inserting the sticky note with a driven roller, wherein the platen roller rotates when the feed roller moves to the insertion position; and relatively moving the platen roller to the separation position and moving the feed roller to the pickup position for a period during which the paste portion of the fed paper passes through the platen roller position.

* * * * *